US010052254B2

(12) United States Patent
Chen

(10) Patent No.: US 10,052,254 B2
(45) Date of Patent: Aug. 21, 2018

(54) APPARATUS AND METHOD FOR ASSISTING PATIENT WALKING THERAPY

(71) Applicant: Phillip Chen, Walnut, CA (US)

(72) Inventor: Phillip Chen, Walnut, CA (US)

( * ) Notice: Subject to any disclaimer, the term of this patent is extended or adjusted under 35 U.S.C. 154(b) by 0 days.

(21) Appl. No.: 15/786,849

(22) Filed: Oct. 18, 2017

(65) Prior Publication Data

US 2018/0104133 A1 Apr. 19, 2018

Related U.S. Application Data

(60) Provisional application No. 62/409,646, filed on Oct. 18, 2016.

(51) Int. Cl.

| | |
|---|---|
| ***A61G 5/10*** | (2006.01) |
| ***A61H 3/04*** | (2006.01) |
| ***A61H 1/02*** | (2006.01) |
| ***A61H 3/00*** | (2006.01) |

(52) U.S. Cl.

CPC ..... *A61H 3/04* (2013.01); *A61G 5/10* (2013.01); *A61H 1/0262* (2013.01); *A61H 3/008* (2013.01); *A61G 5/1005* (2013.01); *A61H 2201/0192* (2013.01); *A61H 2201/1642* (2013.01)

(58) Field of Classification Search

CPC ..... A61G 5/10; A61G 5/14; A61G 2203/80; A61H 3/04; B62B 5/002

See application file for complete search history.

(56) References Cited

U.S. PATENT DOCUMENTS 2,556,121 A * 6/1951 Thomas ..... A61G 5/10 280/304.1

9,351,901 B1 * 5/2016 Petsch ..... A63B 22/001

* cited by examiner

*Primary Examiner* — Bryan A Evans

(74) *Attorney, Agent, or Firm* — Kenneth L. Green; Averill & Green

(57) ABSTRACT

Apparatus and method using two couplings connecting a wheelchair to a walker for safely assisting a patient regaining their ability to walk. Physical therapists use the walker to train patients on walking to build strength, endurance, and balance. The couplings provide a fixed gap between the wheelchair and walker and keeps the wheelchair close to the patient. The patient can easily sit in the wheelchair, and the presence of the wheelchair minimizes the risk of falling, allows the patient to rest when fatigued, provides a sense of security, and eliminates a need for an assistance to push the wheelchair behind the patient.

20 Claims, 4 Drawing Sheets

APPARATUS AND METHOD FOR ASSISTING PATIENT WALKING THERAPY

CROSS-REFERENCE TO RELATED APPLICATIONS

The present application claims the priority of U.S. Provisional Patent Application Ser. No. 62/409,646 filed Oct. 18, 2016, which application is incorporated in its entirety herein by reference.

BACKGROUND OF THE INVENTION

The present invention relates to physical therapy and in particular to attachments from a walker to a wheelchair to assist a patient practicing walking to prevent falls and to rest when fatigue.

Stroke victims and other patients go through an often long and difficult recovery therapy process required to regain strength and control of muscles. One of the most difficult and important aspects of recovery is recovering the ability to walk. Physical therapists often use walkers to train patients on walking to build strength, endurance, and balance. Such training requires an additional personnel to push a wheelchair along behind the patient in case patient is tired or loses balance. Unfortunately, when the wheelchair is not positioned carefully to allow the patient to easily sit, the act of walking often exposes the patient to a risk of falling, which may result in injury.

U.S. Pat. No. 9,351,901 discloses a gate training tool which attaches at one end to a wheelchair and at the other end to a walker. The '091 patent states that "Any form of clamp, hitch, removable connection, or other mechanism for removably attaching the gait training tool 10 to the wheelchair 14 may be used, . . . ", making it clear that the form of the attachment to the wheelchair is not important. Thus, while the tool of the '901 patent somewhat relieves the need for a second personnel to push the wheelchair, the device of the '901 patent allows the wheelchair to twist and turn as the patient walks, and does not position the wheelchair directly behind the patient to allow the patient to easily sit.

Further, during development, the present inventor tested pairs of couplings which, like the '901 patent, are loosely coupled to the wheelchair. The resulting device allowed the wheelchair to move laterally, creating an uncomfortable experience for the patient, not holding the wheelchair directly behind the patient. As a result, a patient trying to sit may fall, and the chance of injury from a fall is increased by the presence of the wheelchair.

BRIEF SUMMARY OF THE INVENTION

The present invention addresses the above and other needs by providing apparatus and method using two couplings connecting a wheelchair to a walker for safely assisting a patient regaining their ability to walk. Physical therapists use the walker to train patients on walking to build strength, endurance, and balance. The couplings provide a fixed gap between the wheelchair and walker and keeps the wheelchair close to the patient. The patient can easily sit in the wheelchair, and the presence of the wheelchair minimizes the risk of falling, allows the patient to rest when fatigued, provides a sense of security, and eliminates a need for an assistance to push the wheelchair behind the patient.

In accordance with one aspect of the invention, there is provided a pair of couplings clamped at opposite ends to the wheelchair and the walker. The couplings include clamping ends with levers to tighten onto the wheelchair and walker. The clamping ends include a high coefficient of friction inner surface, for example a rubber layer, to firmly grasp the wheelchair and walker. The firm grasp resists or prevents rotation of the clamping ends on the wheelchair and walker providing a stable geometry for the patient, and resists pinching the patient between the couplings. The wheelchair is held directly behind the patient, providing confidence to the patient.

In accordance with another aspect of the invention, there are provided couplings used in conjunction with a medical walker and a wheelchair to provide a patient and care giver a sense of security from falling and to rest during practice of walking. The couplings retain the wheelchair a distance behind the walker allowing the patient to use the walker without interference by the wheelchair, and also position the wheelchair to allow the patient to easily sit back into the wheelchair.

In accordance with yet another aspect of the invention, there are provided telescoping couplings used to couple a wheelchair and a medical walker. The separation of the wheelchair and walker may be adjusted for each particular patient to not interfere with walking exercises.

In accordance with still another aspect of the invention, there are provided a method for performing patient walking therapy, including the steps of positioning a patient between the wheelchair and the walker before attaching the first coupling to the wheelchair and to the walker, or after attaching the first coupling to the wheelchair and to the walker and before the second coupling to the wheelchair and to the walker, the lengths of the first and second coupling to the same length to separate the wheelchair and the walker sufficiently to allow the patient room to walk without contacting the wheelchair, attaching the clamping ends of the first and second couplings sufficiently tight to resist to pivoting, and performing the patient walking therapy with the patient residing between the wheelchair and walker and between the two couplings. Attaching the clamping ends of the first and second couplings sufficiently tight to resist to pivoting includes the steps of attaching the clamping ends of the first and second couplings sufficiently tight to resist to pivoting including the steps of pivoting open a cam-lock lever to open a moving jaw of the clamping end, placing the clamping end over a vertical member of the wheelchair or the walker, pivoting closed the cam-lock lever to close the moving jaw of the clamping end on the vertical member, if the moving jaw cannot be locked into position by closing the cam-lock lever, adjust the clamping end for less closing of the moving jaw and repeat pivoting closed the cam-lock lever to close the moving jaw of the clamping end on the vertical member, if the clamping end is not sufficiently tight to cause lateral movement of the couplings to cause the wheelchair or walker to pivot before the couplings rotate on the vertical members, adjust the clamping end for greater closing of the moving jaw and repeat pivoting closed the cam-lock lever to close the moving jaw of the clamping end on the vertical, and repeat pivoting closed the cam-lock lever until the clamping ends are sufficiently tight onto vertical members to cause lateral movement of the couplings to cause the wheelchair or walker to pivot before the couplings pivot on the vertical members.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1:
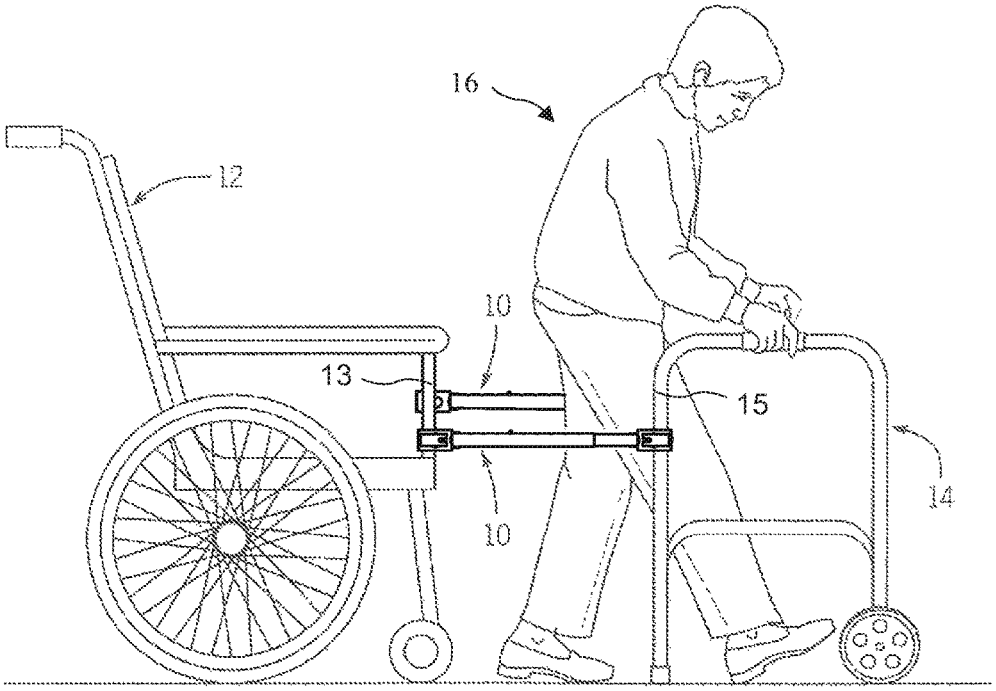
FIG. 1 shows a patient walking between a wheelchair and walker connected by couplings according to the present invention.
Figure 2:
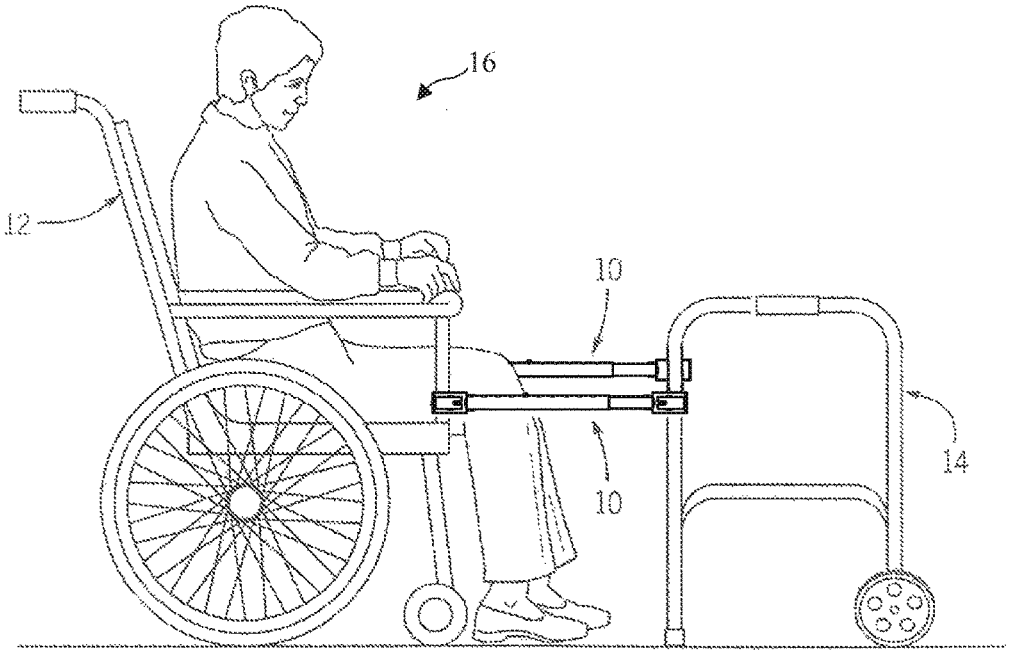
FIG. 2 shows the patient seated in the wheelchair connected to the walker by the couplings according to the present invention.

A patient 16 is shown walking between a wheelchair 12 and walker 14 connected by two couplings 10 according to the present invention is shown in FIG. 1 and the patient 16 seated in the wheelchair 12 connected to the walker 14 by the couplings 10 is shown in FIG. 2. Coupling the wheelchair 12 to the walker 14 allows physical therapists, occupational therapists, and patients/family members to assist the patient 16 while practicing walking and standing with minimal risk of falling and allows the patient 16 to rest when tired in conjunction use of the walker 14. The couplings 10 are preferably connected to vertical members 13 and 15 of the wheelchair 12 and walked 14 respectively.

Figure 3A:
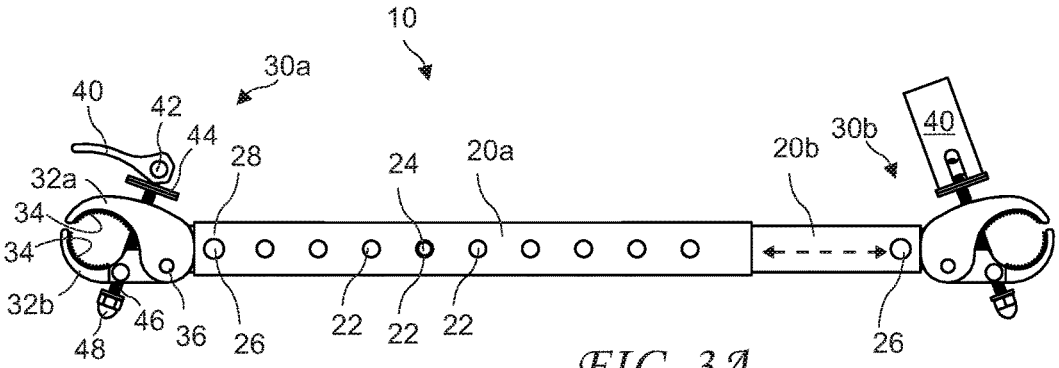
FIG. 3A shows a side view of the couplings according to the present invention.
Figure 3B:
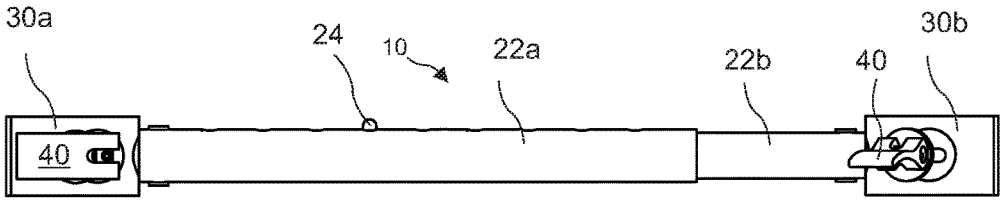
FIG. 3B shows a top view of the couplings according to the present invention.
Figure 4:
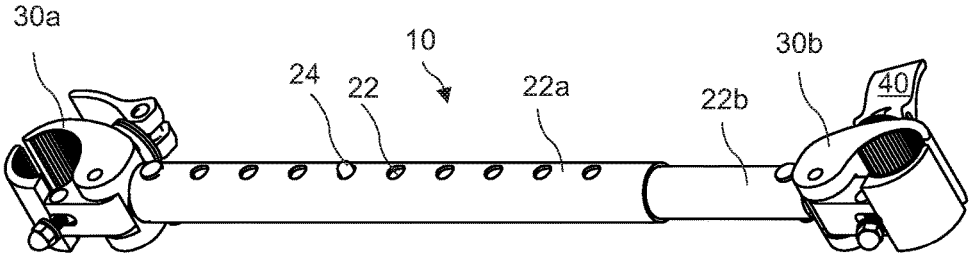
FIG. 4 shows an isometric view of the couplings according to the present invention.

A side view of the couplings 10 is shown in FIG. 3A, a top view of the couplings 10 is shown in FIG. 3B, and an isometric view of the side view of the couplings according to the present invention is shown in FIG. 4. The couplings 10 include rear clamping ends 30*a* for clamping to the wheelchair and front clamping ends 30*b* for clamping to the walker 14. The couplings 10 are telescoping and extendable to about 36 inches in length. An outer tube 20 includes holes 22, and an inner tube 20 includes a plunger 24. The plunger 24 may be depressed to slide the inner tube 20*b* inside the outer tube 20*a* to shorten or lengthen the couplings 10, and the plunger reaches through one of the holes 22 to hold a length of the couplings 10.

The clamping ends 30*a* and 30*b* are attached to the outer and inner tubes 20*a* and 20*b* by pins 26 reaching between opposite sides of the tubes 20*a* and 20*b* and through a cylindrical stud 38 (see FIG. 5A) inserted into an outer end 28 of the outer tube 20*a*. The clamping ends 30*a* and 30*b* include a fixed jaw 32*a* and a moving jaw 32*b* closed by cam-lock lever 40 to adjustably grasp the vertical members 13 and 15 (see FIG. 1) between arced grasping surfaces 34.

Figure 5A:
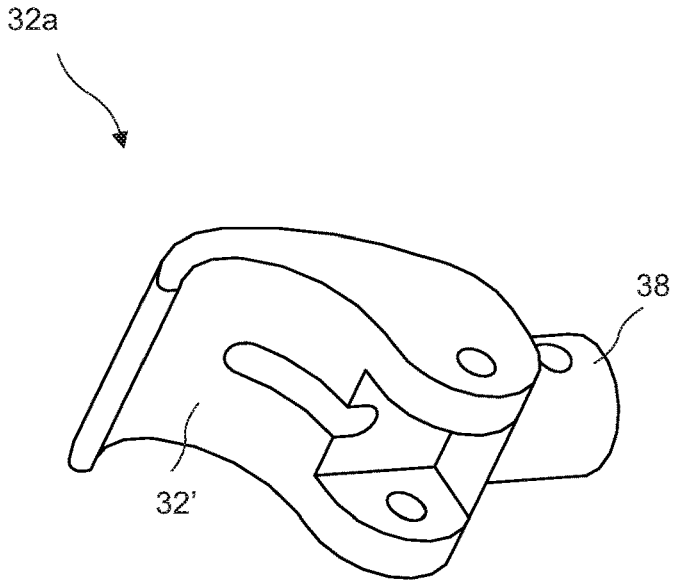
FIG. 5A shows a fixed jaw of the couplings according to the present invention.
Figure 5B:
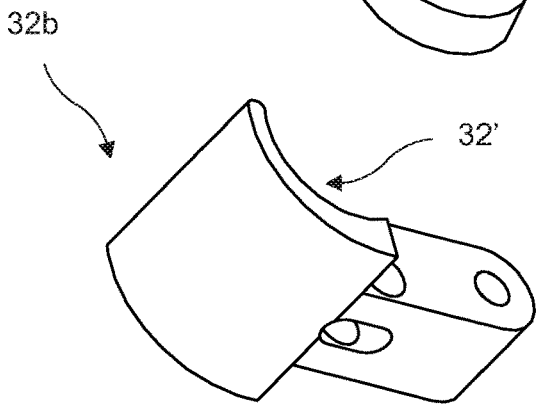
FIG. 5B shows a moving jaw of the couplings according to the present invention.

The fixed jaw 32*a* of the couplings 10 is shown in FIG. 5A, and a moving jaw 32*b* of the couplings 10 is shown in FIG. 5B. The fixed jaw 32*a* includes the cylindrical stud 38 for attaching to the outer tube 20*a*. The fixed jaw 32*a* and moving jaw 20*b* are connected by the pin 36 allowing the moving jaw 20*b* to pivot open and closed. A threaded shaft 46 passed through both the fixed jaw 32*a* and the moving jaw 32*b*, and the fixed jaw 32*a* and the moving jaw 32*b* are captured between a nut 48 and the cam-lock lever 40. The clamping ends 30*a* and 30*b* are closed by rotating the cam-lock lever 40 on a threaded drum 42 and the degree of closing the clamping ends 30*a* and 30*b* is adjusted by turning the cam-lock lever 40 and threaded drum 42 on the threaded shaft 46. A high friction material 32, for example rubber, resides in inner surfaces 32' (see FIGS. 5A and 5B) of the fixed jaw 32*a* and the moving jaw 32*b*. In use, the clamping ends 30*a* and 30*b* are adjusted to resist movement of the couplings 10 on the vertical members 13 and 15 of the wheelchair 12 and walker 14 (see FIG. 1). The clamping ends 30*a* and 30*b* are adjusted by turning the cam-lock levers 40 and threaded drums 42 on the threaded rod 46.

Figure 6:
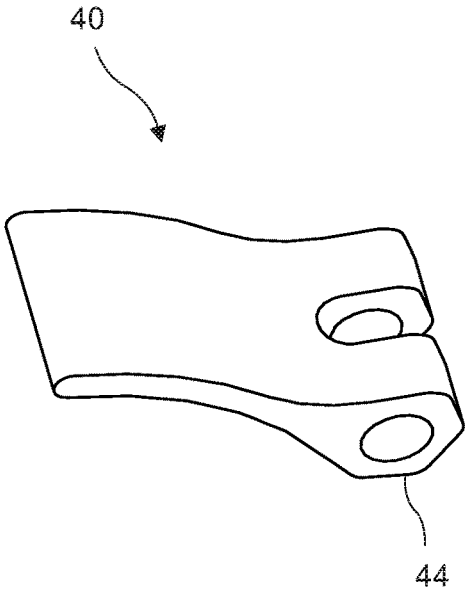
FIG. 6 shows a cam-lock lever of the couplings according to the present invention.

The cam-lock lever 40 of the couplings 10 is shown in FIG. 6. The cam-lock lever 40 includes segments 44. When the cam-lock lever 40 is pivoted on the threaded drum 42, the cam-lock lever 40 settles into position with one of the segments 44 resting against the moving jaw 32*a*. When the clamping end 30*a* or 30*b* is tight, the cam-lock lever 40 is held closed by tension in the threaded rod 46.

The couplings 10 are used by a method including the steps of positioning a patient between the wheelchair and the walker before attaching the first coupling to the wheelchair and to the walker, or after attaching the first coupling to the wheelchair and to the walker and before the second coupling to the wheelchair and to the walker, the lengths of the first and second coupling to the same length to separate the wheelchair and the walker sufficiently to allow the patient room to walk without contacting the wheelchair, attaching the clamping ends of the first and second couplings sufficiently tight to resist to pivoting, and performing the patient walking therapy with a patient residing. Attaching the clamping ends of the first and second couplings sufficiently tight to resist to pivoting includes the steps of attaching the clamping ends of the first and second couplings sufficiently tight to resist to pivoting and performing the patient walking therapy with the patient residing between the wheelchair and walker and between the two couplings. The physical therapist or the caregiver walks alongside the patient without requiring anyone to help push the wheelchair 12. The physical therapist can hold on to a gait belt on the patient with one hand the physical therapist can assist in steering the walker 14 with the hand to assist the patient.

Figure 7:
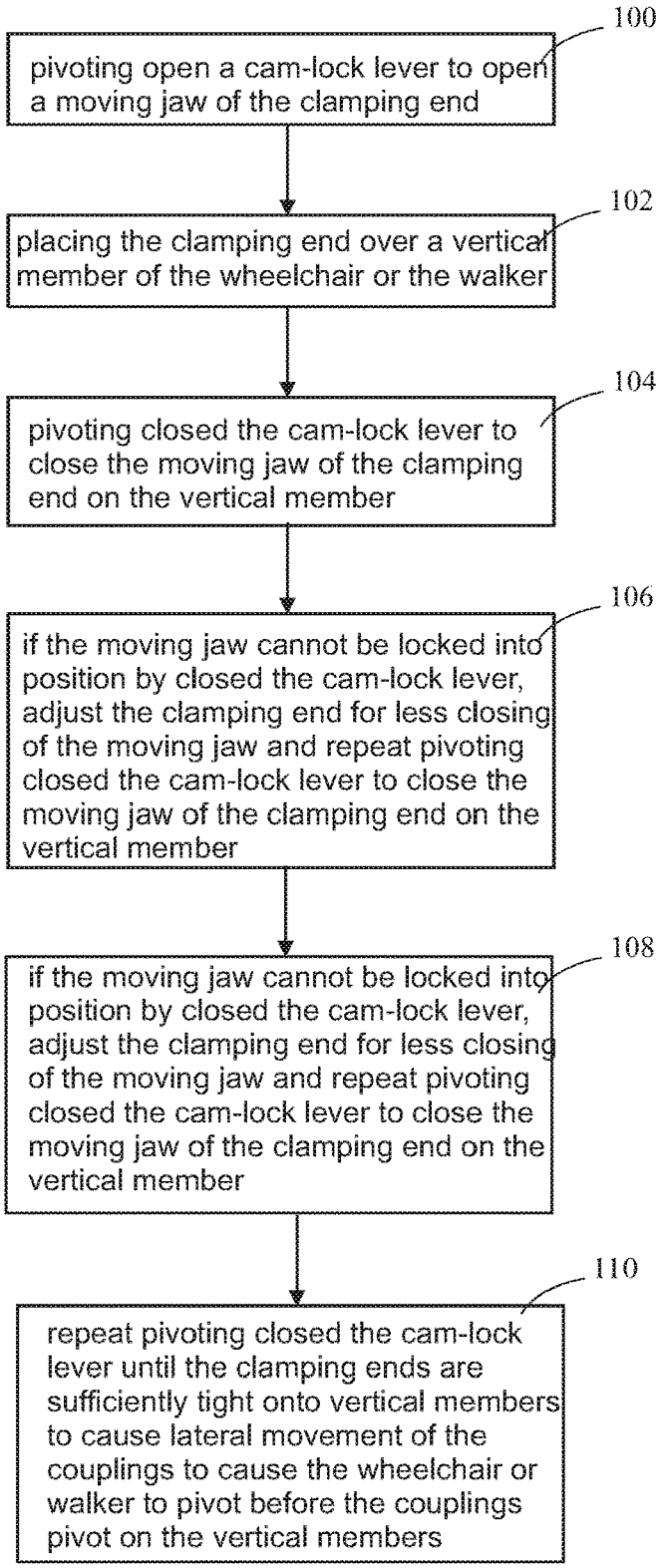
FIG. 7 shows a method for attaching couplings between a wheelchair and a walker, according to the present invention.

A method for attaching the clamping ends of the first and second couplings sufficiently tight to resist to pivoting is shown in FIG. 7. The method includes the steps of pivoting open a cam-lock lever to open a moving jaw of the clamping end at step 100, placing the clamping end over a vertical member of the wheelchair or the walker at step 102, pivoting closed the cam-lock lever to close the moving jaw of the clamping end on the vertical member at step 104, if the moving jaw cannot be locked into position by closing the cam-lock lever, adjust the clamping end for less closing of the moving jaw and repeat pivoting closed the cam-lock lever to close the moving jaw of the clamping end on the vertical member at step 106, if the clamping end is not sufficiently tight to cause lateral movement of the couplings to cause the wheelchair or walker to pivot before the couplings rotate on the vertical members, adjust the clamping end for greater closing of the moving jaw at step 108 and repeat pivoting closed the cam-lock lever to close the moving jaw of the clamping end on the vertical, and repeat pivoting closed the cam-lock lever until the clamping ends are sufficiently tight onto vertical members to cause lateral movement of the couplings to cause the wheelchair or walker to pivot before the couplings pivot on the vertical members at step 110.

While the invention herein disclosed has been described by means of specific embodiments and applications thereof, numerous modifications and variations could be made thereto by those skilled in the art without departing from the scope of the invention set forth in the claims.

I claim:

1. A method for performing patient walking therapy, comprising:

positioning a wheelchair behind a walker, the front of the wheelchair facing the rear of the walker;

attaching a first rear clamping end of a first coupling to the wheelchair and a first front clamping end of the first coupling to the walker, the first rear clamping end adjustable to circumferentially tighten first rear opposing arced surfaces of the first rear clamping end against opposite sides of a first vertical tube of the wheelchair to resist or eliminate rotation of the first coupling with respect to the wheelchair;

attaching a second rear clamping end of a second coupling to the wheelchair and a second front clamping end of the second coupling to the walker, the second rear clamping end adjustable to circumferentially tighten second rear opposing arced surfaces of the second rear clamping end against opposite sides of a second vertical tube of the wheelchair to resist or eliminate rotation of the second coupling with respect to the wheelchair; and performing the patient walking therapy with a patient residing between the wheelchair and walker and between the two couplings.

2. The method of claim 1, further including positioning a patient between the wheelchair and the walker before attaching the first coupling to the wheelchair and to the walker, or after attaching the first coupling to the wheelchair and to the walker and before the second coupling to the wheelchair and to the walker.

3. The method of claim 1, further including positioning a patient between the wheelchair and the walker after attaching the first coupling to the wheelchair and to the walker.

4. The method of claim 1, further including adjusting the lengths of the first and second coupling to the same length to separate the wheelchair and the walker sufficiently to allow the patient room to walk without contacting the wheelchair.

5. The method of claim 1, further including adjusting the front clamping ends to firmly grasp the walker, the front clamping ends adjustable to circumferentially tighten first and second front opposing arced surfaces of the front clamping ends against opposite sides of left and right walker vertical tubes of the walker.

6. The method of claim 1, wherein attaching the first rear clamping end of the first coupling and attaching the second rear clamping end of the second coupling comprises attaching the first and second rear clamping ends sufficiently tight onto the first and second vertical tubes of the wheelchair to cause lateral movement of the first and second couplings to cause the wheelchair to pivot before the first and second couplings pivot on the first and second vertical tubes of the wheelchair.

7. The method of claim 6, wherein attaching the first and second rear clamping ends sufficiently tight onto the vertical tubes of the wheelchair comprises:

pivoting open a cam-lock lever to open a moving jaw of the rear clamping end;

placing the rear clamping end over the vertical tube of the wheelchair;

pivoting closed the cam-lock lever to close the moving jaw of the rear clamping end on the vertical tube of the wheelchair;

If the moving jaw cannot be locked into position by closing the cam-lock lever, adjust the rear clamping end for less closing of the moving jaw and repeat pivoting closed the cam-lock lever to close the moving jaw of the rear clamping end on the vertical tube of the wheelchair;

if the rear clamping end is not sufficiently tight to cause lateral movement of the couplings to cause the wheelchair to pivot before the couplings rotate on the vertical tube, adjust the rear clamping end for greater closing of the moving jaw and repeat pivoting closed the cam-lock lever to close the moving jaw of the rear clamping end on the vertical tube of the wheelchair; and repeat pivoting closed the cam-lock lever until the rear clamping ends are sufficiently tight onto vertical tube of the wheelchair to cause lateral movement of the couplings to cause the wheelchair to pivot before the couplings pivot on the vertical tube.

8. The method of claim 7, wherein the moving jaw and a stationary jaw are lined with a high coefficient material.

9. The method of claim 8, wherein the moving jaw and a stationary jaw are lined with rubber.

10. The method of claim 1, wherein attaching the front clamping ends of the couplings to the walker comprises attaching the front clamping ends sufficiently tight onto walker vertical tubes of the walker to cause lateral movement of the front couplings to cause the walker to pivot before the front couplings pivot on the walker vertical tubes.

11. The method of claim 1, wherein attaching the front clamping ends of the couplings to the walker comprises:

pivoting open a cam-lock lever to open a moving jaw of the front clamping end;

placing the front clamping end over a walker vertical tube of the walker;

pivoting closed the cam-lock lever to close the moving jaw of the front clamping end on the walker vertical tube of the walker;

If the moving jaw cannot be locked into position by closing the cam-lock lever, adjust the front clamping end for less closing of the moving jaw and repeat pivoting closed the cam-lock lever to close the moving jaw of the front clamping end on the walker vertical tube of the walker;

if the front clamping end is not sufficiently tight to cause lateral movement of the couplings to cause the walker to pivot before the first and second couplings rotate on the walker vertical tube, adjust the front clamping end for greater closing of the moving jaw and repeat pivoting closed the cam-lock lever to close the moving jaw of the front clamping end on the walker vertical tube of the walker; and repeat pivoting closed the cam-lock lever until the front clamping ends are sufficiently tight onto the walker vertical tubes of the walker to cause lateral movement of the first and second couplings to cause the walker to pivot before the first and second couplings pivot on the vertical tubes.

12. The method of claim 11, wherein the moving jaw and a stationary jaw are lined with a high coefficient material.

13. The method of claim 12, wherein the moving jaw and a stationary jaw are lined with rubber.

14. The method of claim 1, wherein:

attaching the rear clamping end of the first coupling to the wheelchair and attaching the rear clamping end of the second coupling to the wheelchair comprises attaching the rear clamping ends sufficiently tight onto first vertical tubes of the wheelchair to resist to pivoting of the rear clamping ends on the wheelchair; and attaching the front clamping end of the first coupling to the walker and attaching the front clamping end of the second coupling to the walker comprises attaching the front clamping ends sufficiently tight onto second vertical members of the walker to resist to pivoting of the rear clamping ends on the wheelchair.

15. The method of claim 1, further including attaching first and second rear clamping ends of the first and second couplings to the wheelchair, comprising:

pivoting open a cam-lock lever to open a moving jaw of the rear clamping end;

placing the rear clamping end over a wheelchair vertical tube of the wheelchair;

pivoting closed the cam-lock lever to close the moving jaw of the clamping end on the wheelchair vertical tube;

if the moving jaw cannot be locked into position by closing the cam-lock lever, adjust the clamping end for less closing of the moving jaw and repeat pivoting closed the cam-lock lever to close the moving jaw of the rear clamping end on the wheelchair vertical tube;

if the rear clamping end is not sufficiently tight to cause lateral movement of the first and second couplings to cause the wheelchair to pivot before the first and second couplings rotate on the wheelchair vertical tube, adjust the rear clamping end for greater closing of the moving jaw and repeat pivoting closed the cam-lock lever to close the moving jaw of the rear clamping end on the wheelchair vertical tube; and repeat pivoting closed the cam-lock lever until the rear clamping ends are sufficiently tight onto wheelchair vertical tube to cause lateral movement of the first and second couplings to cause the wheelchair to pivot before the first and second couplings pivot on the wheelchair vertical tube.

16. The method of claim 1, wherein performing the patient walking therapy with a patient residing between the wheelchair and walker and between the two couplings comprises a physical therapist or caregiver walking alongside the patient without a second physical therapist or second caregiver, the physical therapist or caregiver holding on to a gait belt on the patient with one hand and assisting in steering the walker to assist the patient.

17. A method for performing patient walking therapy, comprising:

positioning a patient between the wheelchair and the walker before attaching the first coupling to the wheelchair and to the walker, or after attaching the first coupling to the wheelchair and to the walker and before the second coupling to the wheelchair and to the walker;

adjusting the lengths of the first and second coupling to the same length to separate the wheelchair and the walker sufficiently to allow the patient room to walk without contacting the wheelchair;

attaching the clamping ends of the first and second couplings sufficiently tight to resist to pivoting comprising:

pivoting open a cam-lock lever to open a moving jaw of the clamping end;

placing the clamping end over a vertical member of the wheelchair or the walker;

pivoting closed the cam-lock lever to close the moving jaw of the clamping end on the vertical member;

if the moving jaw cannot be locked into position by closing the cam-lock lever, adjust the clamping end for less closing of the moving jaw and repeat pivoting closed the cam-lock lever to close the moving jaw of the clamping end on the vertical member;

if the clamping end is not sufficiently tight to cause lateral movement of the couplings to cause the wheelchair or walker to pivot before the couplings rotate on the vertical members, adjust the clamping end for greater closing of the moving jaw and repeat pivoting closed the cam-lock lever to close the moving jaw of the clamping end on the vertical; and repeat pivoting closed the cam-lock lever until the clamping ends are sufficiently tight onto vertical members to cause lateral movement of the couplings to cause the wheelchair or walker to pivot before the couplings pivot on the vertical members; and performing the patient walking therapy with a patient residing in the wheelchair.

18. A method for performing patient walking therapy, comprising:

positioning a wheelchair behind a walker, the front of the wheelchair facing the rear of the walker;

attaching a first rear clamping end of a first coupling to the wheelchair and a first front clamping end of the first coupling to the walker, the first front clamping end adjustable to circumferentially tighten first front opposing arced surfaces of the first front clamping end against opposite sides of a first vertical tube of the walker;

attaching a second rear clamping end of a second coupling to the wheelchair and a second front clamping end of the second coupling to the walker, the second front clamping end adjustable to circumferentially tighten second rear opposing arced surfaces of the second front clamping end against opposite sides of a second vertical tube of the walker; and performing the patient walking therapy with a patient residing between the wheelchair and walker and between the two couplings.

19. The method of claim 18, wherein attaching the front clamping ends of the couplings to the walker comprises:

pivoting open a cam-lock lever to open a moving jaw of the front clamping end;

placing the front clamping end over a walker vertical tube of the walker;

pivoting closed the cam-lock lever to close the moving jaw of the front clamping end on the walker vertical tube of the walker;

If the moving jaw cannot be locked into position by closing the cam-lock lever, adjust the front clamping end for less closing of the moving jaw and repeat pivoting closed the cam-lock lever to close the moving jaw of the front clamping end on the walker vertical tube of the walker;

if the front clamping end is not sufficiently tight to cause lateral movement of the couplings to cause the walker to pivot before the first and second couplings rotate on the walker vertical tube, adjust the front clamping end for greater closing of the moving jaw and repeat pivoting closed the cam-lock lever to close the moving jaw of the front clamping end on the walker vertical tube of the walker; and repeat pivoting closed the cam-lock lever until the front clamping ends are sufficiently tight onto the walker vertical tubes of the walker to cause lateral movement of the first and second couplings to cause the walker to pivot before the first and second couplings pivot on the vertical tubes.

20. The method of claim 18, wherein attaching the rear clamping ends of the couplings to the wheelchair comprises:

pivoting open a cam-lock lever to open a moving jaw of the rear clamping end;

placing the rear clamping end over a wheelchair vertical tube of the wheelchair;

pivoting closed the cam-lock lever to close the moving jaw of the clamping end on the wheelchair vertical tube;

if the moving jaw cannot be locked into position by closing the cam-lock lever, adjust the clamping end for less closing of the moving jaw and repeat pivoting closed the cam-lock lever to close the moving jaw of the rear clamping end on the wheelchair vertical tube;

if the rear clamping end is not sufficiently tight to cause lateral movement of the first and second couplings to cause the wheelchair to pivot before the first and second couplings rotate on the wheelchair vertical tube, adjust the rear clamping end for greater closing of the moving jaw and repeat pivoting closed the cam-lock lever to close the moving jaw of the rear clamping end on the wheelchair vertical tube; and repeat pivoting closed the cam-lock lever until the rear clamping ends are sufficiently tight onto wheelchair vertical tube to cause lateral movement of the first and second couplings to cause the wheelchair to pivot before the first and second couplings pivot on the wheelchair vertical tube.

* * * * *